United States Patent [19]

McCann

[11] 4,311,566

[45] Jan. 19, 1982

[54] ELECTROLYTE PERMEABLE DIAPHRAGM

[75] Inventor: Mary E. McCann, Corpus Christi, Tex.

[73] Assignee: PPG Industries, Inc., Pittsburgh, Pa.

[21] Appl. No.: 173,774

[22] Filed: Jul. 30, 1980

[51] Int. Cl.[3] ..... C23B 1/34; C23B 13/02; C23B 13/08; C23B 13/04

[52] U.S. Cl. ..... 204/98; 204/128; 204/252; 204/283; 204/295; 204/296

[58] Field of Search ..... 204/283, 296, 295, 98, 204/128, 252

[56] References Cited

U.S. PATENT DOCUMENTS

| | | | |
|---|---|---|---|
| 1,942,183 | 1/1934 | Muller | 204/28 |
| 3,116,355 | 12/1963 | Oswin | 204/295 |
| 3,424,659 | 1/1964 | Staal | 204/295 |
| 3,703,413 | 11/1972 | Arrance | 136/6 |
| 4,021,327 | 5/1977 | Grot | 204/98 |
| 4,098,758 | 5/1978 | McAloon | 204/98 |
| 4,135,996 | 1/1979 | Bouy et al. | 204/98 |

FOREIGN PATENT DOCUMENTS

| | | |
|---|---|---|
| 1081046 | 8/1967 | United Kingdom . |
| 1424804 | 2/1976 | United Kingdom . |

*Primary Examiner*—R. L. Andrews
*Attorney, Agent, or Firm*—Richard M. Goldman

[57] ABSTRACT

Disclosed is an electrolyte permeable, non-asbestos diaphragm for chlor-alkali electrolytic cells. The diaphragm is a cohesive matrix of a non-asbestos structural component and a binder, and is prepared by codepositing the non-asbestos structural component and the binder, along with a pore forming component, from a slurry, rendering the binder thermoplastic, and removing the pore forming component. Also disclosed is a method of preparing the diaphragm, a method of utilizing the diaphragm, and an electrolytic cell containing the diaphragm.

56 Claims, No Drawings

ELECTROLYTE PERMEABLE DIAPHRAGM

DESCRIPTION OF THE INVENTION

Chlorine and alkali metal hydroxides, e.g., sodium hydroxide and potassium hydroxide, are produced industrially by the electrolysis of the corresponding chlorides, e.g., sodium chloride and potassium chloride, typically as an aqueous solution of the chloride, that is, as a brine.

The electrolysis may be carried out in a mercury cell, in a permionic membrane cell, or in a diaphragm cell. Diaphragm cells have an electrolyte permeable diaphragm separating the anode from the cathode, with a hydrostatic head across the cell whereby to cause anolyte to flow from the anolyte compartment to the catholyte compartment. In this way a catholyte product of alkali metal hydroxide and alkali metal chloride is produced. Where the feed brine is sodium chloride, the catholyte liquor typically contains from about 10 to about 15 percent by weight sodium hydroxide, and from about 10 to about 25 percent by weight sodium chloride. Where the feed brine is potassium chloride, the catholyte product typically contains from about 10 to about 25 percent by weight potassium hydroxide, and from about 12 to about 35 weight percent potassium chloride.

Typically, the electrolyte permeable diaphragms of the prior art have been provided by asbestos. This is due to the ease of deposition of asbestos from slurries, especially on convoluted and shaped cathodes. Additionally asbestos is self-adherent, that is, binders are generally not required. Moreover, asbestos has been characterized by a long life in cell operations, i.e., from about 9 months to about 15 months.

However, presently significant incentives exist to replace asbestos with other, non-asbestos, fibrous and particulate materials. Various non-asbestos diaphragms have been prepared. For example, U.S. Pat. No. 1,942,183 describes the diaphragm of barium sulfate with a glutinous binder. U.S. Pat. No. 3,930,979 describes a preformed sheet diaphragm of porous halocarbon resin, prepared by making a sheet of the halocarbon resin and removable filler, such as starch, cellulose, or the like, and thereafter removing the filler. U.S. Pat. No. 4,020,235 describes a diaphragm of a preformed sheet of inert fibers and halogenated hydrocarbon binder, while U.S. Pat. No. 4,036,729 describes a sheet of entangled fibers without a binder. U.S. Pat. No. 4,089,758 describes a preformed diaphragm of polytetrafluoroethylene plus a nonremovable filler or binder prepared by heating the diaphragm, stretching the diaphragm, cooling the diaphragm, and thereafter releasing the tension on the diaphragm.

U.S. Pat. No. 4,098,672 describes a preformed diaphragm of polytetrafluoroethylene and a solid particulate organic fillers. U.S. Pat. No. 4,126,536 describes a preformed diaphragm of polytetrafluoroethylene and a filler chosen from the group consisting of titanium dioxide, barium sulfate, and potassium titanate. U.S. Pat. No. 4,170,540 describes a diaphragm that is preformed by blending fluorocarbon particles, a particulate additive, and a surfactant in a sheet and removing the pore forming particulate additive, i.e., the maize, starch, or colloidal material.

The above patents describe preformed diaphragms, that is, sheets that are preformed prior to installation in an electrolytic cell. While preformed diaphragms are satisfactory for simple electrode shapes, such as planar electrodes, they are not satisfactory for the complex shapes contemplated herein, that is fingered electrodes, and interleaved electrodes which require a slurry depositable, in situ cured diaphragm material.

It has now been found that a particularly desirable, slurry depositable, in situ curable diaphragm may be prepared by forming a slurry of a fibrous or particulate material as the structure, a pore forming component and a binder, and drawing the slurry through the cathode to deposite the solids onto the cathode. The deposited solids are then heated to bind the fibrous or particulate material and the binders into a cohesive mass and destroy the pore former. The pore forming component may be destroyed during heating and binding such as by burning, oxidizing, or evaporation, or after installation in the cell, as to solution by the electrolyte.

According to a further exemplification of the invention herein contemplated, sepiolite, a naturally occurring magnesium silicate, may be applied atop the diaphragm as a coating.

DETAILED DESCRIPTION OF THE INVENTION

Disclosed herein is a deposited diaphragm including the cathode diaphragm element, and an electrolytic cell utilizing the deposited diaphragm, a method of electrolysis using the diaphragm, and the method of preparing the diaphragm.

The diaphragm herein contemplated is an electrolyte permeable diaphragm. That is, it allows the flow of anolyte liquor, i.e., sodium chloride or potassium chloride, from the anolyte compartment to the catholyte compartment under a moderate head of brine, i.e., a 5 to 40 inch head of brine, whereby to overcome the effects of back migration of hydroxyl ion from the catholyte compartment to the anolyte compartment under the influence of the electrical field.

Moreover, the diaphragm herein contemplated is slurry depositable and in situ curable. This allows its use on fingered cathodes, especially narrow pitched fingered cathodes that are not readily amendable to the utilization of preformed diaphragm sheets.

As herein utilized, the term "mass average particle length" and "mass average particle diameter" when referring to the size range, length, and diameter of the components of the slurry, means that size range within which 50 percent or more by weight of the material under discussion is contained.

As used herein, the term "non-asbestos material" refers to the fibrous or particulate structural material, and means that asbestos is not required or necessary in the diaphragm although the presence thereof is not deleterious as an impurity to the diaphragm.

The diaphragm contemplated herein is deposited on a cathode and utilized in combination with the cathode. The cathode, including the cathode substrate and catalytic surface thereon, if any, is preferably foraminous, for example, a perforated sheet, a perforated plate, mesh, expanded mesh, or screen. When it is mesh it may be expanded, calendered, or flattened, i.e., rolled.

The cathode has an electroconductive substrate which may, optionally, have a catalytic surface thereon. By an electroconductive substrate is meant a metal substrate, for example, iron, cobalt, nickel, copper, as well as admixtures and alloys thereof, e.g., stainless steel, mild steel, and the like, or a graphite substrate.

Preferably, the cathode substrate is a metal substrate. Generally it is an iron substrate.

The substrate typically has an open area of from about 20 to about 80 percent, and preferably from about 35 to about 65 percent. One particularly desirable cathode substrate is calendered iron mesh having from about 4 to 8 mesh per inch in each direction, i.e., from about 16 to about 64 mesh per square inch, and from about 35 to about 65 percent open area. A substrate having approximately 40 percent open area, and 6 mesh per linear inch, i.e., 36 openings per square inch, and fabricated of 0.067 inch diameter steel is utilized industrially in the electrolysis of sodium chloride brine to produce chlorine and caustic soda.

By a catalytic surface is meant that the surface material on the cathode substrate has a lower hydrogen overvoltages than the cathode substrate. Preferably, the catalytic surface is a high surface area material, having a surface area of from about 20 square meters per gram to about 200 square meters per gram, and the surface material is resistant to the effects of caustic soda at the concentrations contemplated herein.

The diaphragm is cohesive to itself and to the cathode substrate. That is, the individual fibrous materials adhere to each other, through the medium of the binder, thereby providing a measurable wet strength such that the diaphragm is not readily abraided by evolved gases.

The diaphragm and the diaphragm cathode unit are permeable to the electrolyte. That is, the diaphragm allows anolyte liquor to pass therethrough from the anolyte compartment to the catholyte compartment under a hydrostatic head of greater than about 5 inches, and preferably from about 5 to about 40 inches whereby to provide a catholyte containing from about 10 to 15 percent caustic soda, and from about 10 to about 25 percent sodium chloride at a current efficiency of about 90 percent or more under a hydrostatic head as described above.

The weight of diaphragm material is typically from about 0.1 to about 0.5 pounds of diaphragm material per square foot with a void volume of about 25 to about 80 percent. In this way there is provided an adherent, non-asbestos, fibrous, cohesive, diaphragm having a thickness of from about 0.02 to about 0.1 inch thick. Thinner diaphragms may be utilized, although care must be taken to avoid back migration of hydroxyl ion from the catholyte compartment to the anolyte compartment. Thicker diaphragms, i.e., diaphragms thicker than about 0.1 inch may be utilized, although a higher head may be required.

The diaphragm herein contemplated has a non-asbestos structural material, either fibrous or particulate, and binder on the cathode. The diaphragm-cathode unit is utilized in an electrolytic cell having an anolyte compartment separated from a catholyte compartment by the deposited, in situ cured diaphragm of non-asbestos fibers and binder prepared as described herein below.

In an electrolytic cell, the diaphragm is utilized as an element in the operation of the cell whereby to conduct electrolysis of the sodium chloride or potassium chloride feed. The brine is fed to the anolyte compartment and an electrical potential and hydrostatic head are imposed across the cell. Chlorine is evolved at the anode. The head across the cell, i.e., above about 5 inches and preferably from about 5 to about 40 inches, although higher or lower heads are not deleterious, drives anolyte liquor from the anolyte compartment to the catholyte compartment at a sufficient flow rate to prevent significant back migration from the catholyte compartment to the anolyte compartment, thereby to provide a catholyte liquor containing in excess of from about 8 and preferably above about 10 weight percent sodium hydroxide, and from about 10 to about 18 weight percent sodium chloride at a cathode current efficiency in excess of 90 percent. The diaphragm being slurried and deposited and cured in situ by the methods described herein below.

The cathode herein contemplated is prepared by preparing a slurry of a solvent, a non-asbestos fibrous or particulate material, i.e., a structural component, a binder, and a pore forming component.

The solvent, i.e., the liquid medium, should be such as to evaporate below the distortion or softening or melting temperature of the binder whereby to avoid bubbles or voids in the binder, and have a density, viscosity, and surface tension such as to maintain the slurry. Typically, the viscosity is above about 10 centiposies at 27 Centigrade, and preferably from about 10 to about 100 centiposies, and the density is from about 1.0 to about 1.5 grams per cubic centimeter. Typical solvents meeting these criteria, and having satisfactory surface tension include methyl-ethyl glycol, cyclohexanol, ethanol, methanol, butanol, isobutanol, octyl alcohol, propyl alcohol, phenol, linseed oil, ethylene glycol, diethylen glycol, and glycerol. Especially preferred are alcohols and diols having a viscosity of from about 10 to about 100 centiposies, a density of from about 1.0 to about 1.5, and a surface tension such as to keep the solids slurried.

The non-asbestos fibrous or particulate material provides the structural diaphragm. That is, it is the structural element that, when held together in a cohesive mass by the binder, provides the diaphragm. It typically has a mass average diameter of from 0.2 to about 100 microns, and preferably from about 1 to about 10 microns, and for fibrous materials a length of from about 1 to about 1000 microns, and preferably from 1 to about 500 microns, and an aspect ratio, that is a ratio of diameter to length of from about 1:1 to about 1:1000. The non-asbestos material may be fibers, such as filaments, whiskers, or enlongate crystals, or they may be particulate.

Typical fibrous or particulate materials used to provide the structure of the diaphragm include zirconia, titania, barium sulfate, barium titanate, potassium titanate and alumina. Especially preferred is zirconia.

Alternatively, the non-asbestos material providing the structural diaphragm may be a fluorocarbon resin having a higher melting point than the binder. This is so that the structural material remains a rigid, non-malleable solid fiber or particle when the binder is a thermoplastic, tacky liquid. Especially preferred fluorocarbon resins are polytetrafluoroethylene.

The binder is a thermoplastic resin, resistant to acidified, chlorinated brine. Typically, the binder is in a size range of from 1 to about 10 microns in diameter, and from about 100 to about 500 microns in length, although particles, essentially substantially spherical particles having a size of from about 1 to about 1000 microns may alternatively be utilized. Similarly, latexes, suspensions, and dispersions of the binder material may be utilized. Especially preferred binder materials are homopolymers and copolymers. Especially preferred copolymers are those having the formula where $-(CX_1X_2-CX_3X_4)(CY_1Y_2-CY_3Y_4)-$ $X_1$, $X_2$, $X_3$, $X_4$, $Y_1$, $Y_2$, $Y_3$, and $Y_4$ may be fluorine, chlorine, or hydrogen, and at least one of them is fluorine. That is, all of $Y_1$, $Y_2$, $Y_3$ and $Y_4$ may be hydrogen, but at least one of, for example, $X_1$, $X_2$, $X_3$, or $X_4$ is fluorine as in copolymers of ethylene with vinyl fluoride $-(H_2-CHF)-$, vinylidene fluoride $-(CH_2-CF_2)-$, trifluoroethylene $-(CHF-CF_2)-$, perfluoroethylene $-(CF_2-CF_2)-$, and chlorotrifluoroethylene $-(CF_2-CClF)-$, where the copolymers of perfluoroethylene and ethylene and the copolymers of chlorotrifluoroethylene and ethylene are especially preferred. Alternatively, the binder may be a homopolymer of a thermoplastic chloro carbon resin, for example, a homopolymer of vinylchloride, or vinylidene chloride. Alternatively, the binder may be a perfluorinated hydrocarbon having thermoplastic behavior at elevated temperatures, such as fluorinated ethylene-propylene (FEP), or perfluoroalkoxy (PFA) materials.

The pore forming component may be a particulate or fiber, having a size range of from about 5 to about 100 microns for naturally occurring materials, a diameter of from about 5 to about 100 microns, and a length of from about 5 to about 2000 microns, and synthetic materials having a diameter range of from about 1 to about 100 microns, and a length of from about 1 to about 1000 microns or more.

The pore forming component should be a material that burns, vaporizes, or oxidizes at temperatures where the thermoplastic resin becomes viscous and tacky, or should be a material that is readily solubilized by the electrolyte. Typical (naturally occurring) pore forming materials include hydrocarbons, silk, wool, and cellulosics such as cotton, paper, and wood. Especially preferred are cellulosics. Alternatively, the pore forming component may be a synthetic hydrocarbon polymer such as rayon, nylon, or polyethylene.

The slurry typically contains from 0.5 to about 20 weight percent solids. Typically, about 30 to about 70 percent of the solids are the non-asbestos fibers or particulate material, and from about 30 to about 50 percent of the solids are the binders with the balance being the pore formers. However, higher or lower fractions of pore formers may be used, depending upon the thickness of the intended diaphragm, whereby to provide control over the porosity and permeability thereof.

The diaphragm is prepared by drawing or pouring the slurry through the cathode, i.e., a horizontal or vertical cathode, or pouring the slurry onto a horizontal cathode and thereafter drawing the slurry material through. Typically, a vacuum of from about 15 inches to about 1 atmosphere, and preferably from about 17 inches to about 22 inches of mercury if utilized whereby to draw the solvent through the deposit and porous cathode leaving behind a partially compressed deposit. Thereafter, the deposit is dried, i.e., at a temperature of from about 100° to about 150° C. or higher, whereby to drive off the solvent while avoiding melting of the thermoplastic binder. Subsequently, the cathode and deposit are heated to a temperature sufficient to render the binder thermoplastic, i.e., from about 275° C. to about 375° C. for from about 5 minutes to about 4 hours or more whereby to melt the binder and cause the binder to adhere to non-asbestos fibrous material.

According to one exemplification of the invention, a slurry of about 25 gallons of ethylene glycol and 2 pounds of solids is prepared. The slurry contains about 1 pound of zirconia, with about 50 weight percent of the zirconia being between 100 and 1000 microns in length, 1 pound of Allied Chemical Corp. HALAR ®, an alternating copolymer of chlorotrifluoroethylene and ethylene, and 65 grams of pulverized cellulose. The slurry is stirred for about 2 hours, and then is drawn through a 6 mesh per inch by 6 mesh per inch mild steel cathode having 60% open area, under a vacuum of approximately 22 inches of mercury. Thereafter, the deposit and cathode substrate are heated 125° C. from about 100° to 150° C. for about 1 to about 24 hours to dry the diaphragm and thereafter heat it to above about 235° C. for at least about 30 minutes whereby to destroy the cellulose and to cause the poly(chlorotrifluoroethylene-ethylene) to bind the zirconia fibers. Thereafter, the cathode-diaphragm assembly is assembled into an electrolytic cell having a coated titanium anode, sodium chloride brine is fed to the anolyte compartment, and electrical potential is imposed across the cell as is a head of about 20 inches of brine, and a catholyte liquor of sodium hydroxide and sodium chloride is recovered therefrom.

According to a further exemplification of this invention, sepiolite may be added to the anolyte liquor or coated onto the diaphragm, i.e., at a rate of about 8 grams per square foot of diaphragm area per addition or less, whereby to provide a non-fibrous, magnesium silicate coating on the diaphragm.

The following example is illustrative:

EXAMPLE

A poly(chlorotrifluoroethylene-ethylene) copolymer bound zirconia fiber diaphragm was prepared and tested in a laboratory diaphragm.

A slurry was prepared containing 18 liters of ethylene glycol, and 0.5 weight percent solids, i.e., 100.5 grams of solids. The solid fraction of the slurry was 45.23 grams of zirconia fibers having a median length of 2.5 microns, 10.5 grams of pulverized glassine paper cellulose, and 45.23 grams of Allied Chemical Corp. HALAR ® alternating chlorotrifluoroethylen-ethylene copolymer.

The slurry was deposited on a mild steel wire mesh cathode having 6 mesh per inch of mild steel wire, and approximately 60 percent open area. A vacuum of 4 centimeters of mercury was initially drawn and increased to 5 centimeters over 5 minutes, and to 8.5 centimeters over a subsequent 6 minutes, whereby to deposit the solids.

The deposit was then dried by heating to 110 degrees C. for 16 hours, and then heated to 265 degrees C. for one hour. The resulting diaphragm had a weight of about 0.25 pounds per square foot.

The cathode and diaphragm were then installed in a laboratory test cell with a ruthenium dioxide-titanium dioxide coated titanium mesh anode, spaced from the cathode. Electrolysis was commenced at a current density of 190 Amperes per square foot.

During the first week of electrolysis, three additions of 8 grams of sepiolite, $MgO.xSiO_2$, per square foot of cathode area were made to the anolyte. Thereafter, no additions of sepiolite were made for two weeks, and then one addition of 8 grams of sepiolite per square foot of cathode area was made. After four weeks of electrolysis, the brine head was seven inches, the cell voltage was 3.30 volts, the catholyte liquor contained 10.8 weight percent sodium hydroxide, and the cathode current efficiency was 91.3 percent.

While the invention has been described with respect to certain embodiments and exemplifications thereof, the scope of the invention is not to be so limited except as in the claims appended hereto.

I claim:

1. A method of forming an electrolyte permeable diaphragm on a foraminous structure comprising:
   a. providing a slurry comprising a solvent, a pore forming component, a non-asbestos structural component, and a binder;
   b. drawing the slurry through the foraminous structure whereby to deposit the pore forming component, the non-asbestos structural component, and the binder thereon;
   c. forming a cohesive matrix of the non-asbestos structural component and the binder; and
   d. removing the pore forming component.

2. The method of claim 1 wherein the pore forming component is removed during formation of the cohesive matrix.

3. The method of claim 1 wherein the pore forming component is chosen from the group consisting of hydrocarbon resins and naturally occurring organic fibers.

4. The method of claim 3 wherein the pore forming component is a cellulosic fiber.

5. The method of claim 1 wherein the binder is a thermoplastic halocarbon resin.

6. The method of claim 5 wherein the thermoplastic halocarbon resin is chosen from the group consisting of fluorinated ethylene propylene, perfluoroalkoxy, copolymers having the moieties $$\text{-}(CX_1X_2\text{—}CX_3X_4)\text{-}$$

and $$\text{-}(CY_1Y_2\text{—}CY_3Y_4)\text{-},$$

and homopolymers having the moieties $$\text{-}(CCY_1Y_2\text{—}CY_3F)\text{-}$$

where $X_1$, $X_2$, $X_3$, $X_4$, $Y_1$, $Y_2$, $Y_3$, and $Y_4$ are chosen from the group consisting of —F, —Cl, and H, at least one of said $X_1$, $X_2$, $X_3$, $X_4$, $Y_1$, $Y_2$, $Y_3$, and $Y_4$ being —F.

7. The method of claim 6 wherein the thermoplastic resin is chosen from the group consisting of copolymers having a fluorocarbon resin moiety chosen from the group consisting of $$\text{-}(CFH\text{—}CH_2)\text{-},$$

$$\text{-}(CF_2\text{—}CH_2)\text{-},$$

$$\text{-}(CF_2\text{—}CFH)\text{-},$$

$$\text{-}(CF_2\text{—}CF_2)\text{-}, \text{ and}$$

$$\text{-}(CF_2\text{—}CClF)\text{-}$$

and an ethylene moiety.

8. The method of claim 1 wherein the non-asbestos structural component is a mineral fiber chosen from the group consisting of zirconia, titania, barium sulfate, barium titanate, potassium titanate, and alumina.

9. The method of claim 8 wherein the non-asbestos structural component is zirconia.

10. The method of claim 1 wherein the non-asbestos structural component is a resin capable of remaining undeformed at temperatures where the binder is thermoplastic.

11. The method of claim 10 wherein the non-asbestos structural component is polytetrafluoroethylene.

12. The method of claim 1 wherein the solvent has a viscosity greater than about 10 centipoise.

13. The method of claim 1 wherein the solvent has a density of about 1.0 to about 1.5 grams per cubic centimeter.

14. The method of claim 1 comprising coating the surface of the diaphragm with sepiolite.

15. In a method of electrolyzing an alkali metal chloride brine chosen from the group consisting of potassium chloride and sodium chloride in an electrolytic cell having an anolyte compartment with an anode therein, a catholyte compartment with a cathode therein, and an electrolyte permeable diaphragm therebetween, which method comprises feeding the brine to the anolyte compartment, imposing an electrical potential across the cell whereby to evolve chlorine at the anode, imposing a hydrostatic head across the cell whereby to drive electrolyte from the anolyte compartment to the catholyte compartment, and recovering chlorine from the anolyte compartment and cell liquor containing alkali metal chloride and alkali metal hydroxide from the catholyte compartment, the improvement wherein the diaphragm is deposited on the cathode by the method comprising:
   a. providing a slurry comprising a solvent, a pore forming component, a non-asbestos structural component, and a binder;
   b. drawing the slurry through the foraminous structure whereby to deposit the pore forming component, the non-asbestos structural component, and the binder thereon;
   c. forming a cohesive matrix of the non-asbestos structural component and the binder; and
   d. removing the pore forming component.

16. The method of claim 15 wherein the pore forming component is removed during formation of the cohesive matrix.

17. The method of claim 15 wherein the pore forming component is chosen from the group consisting of hydrocarbon resins and naturally occurring organic fibers.

18. The method of claim 17 wherein the pore forming component is a cellulosic fiber.

19. The method of claim 15 wherein the binder is a thermoplastic halocarbon resin.

20. The method of claim 19 wherein the thermoplastic halocarbon resin is chosen from the group consisting of fluorinated ethylene propylene, perfluoroalkoxy, copolymers having the moieties $$\text{-}(CX_1X_2\text{—}CX_3X_4)\text{-}$$

and $$\text{-}(CY_1Y_2\text{—}CY_3Y_4)\text{-},$$

and homopolymers having the moieties $$\text{-}(CY_1Y_2\text{—}CY_3F)\text{-}$$

where $X_1$, $X_2$, $X_3$, $X_4$, $Y_1$, $Y_2$, $Y_3$, and $Y_4$ are chosen from the group consisting of —F, —Cl, and H, at least one of said $X_1$, $X_2$, $X_3$, $X_4$, $Y_1$, $Y_2$, $Y_3$, or $Y_4$ being —F.

21. The method of claim 6 wherein the thermoplastic resin is chosen from the group consisting of copolymers having a fluorocarbon resin moiety chosen from the group consisting of $-(CFH-CH_2)-$, $-(CF_2-CH_2)-$, $-(CF_2-CFH)-$, $-(CF_2-CF_2)-$, and $-(CF_2-CClF)-$ and an ethylene moiety.

22. The method of claim 15 wherein the non-asbestos structural component is a mineral fiber chosen from the group consisting of zirconia, titania, barium sulfate, barium titanate, potassium titanate, and alumina.

23. The method of claim 22 wherein the non-asbestos structural component is zirconia.

24. The method of claim 15 wherein the non-asbestos structural component is a resin capable of remaining undeformed at temperatures where the binder is thermoplastic.

25. The method of claim 24 wherein the non-asbestos structural component is polytetrafluoroethylene.

26. The method of claim 15 wherein the solvent has a viscosity greater than about 10 centipoise.

27. The method of claim 15 wherein the solvent has a density of about 1.0 to about 1.5 grams per cubic centimeter.

28. The method of claim 15 comprising adding sepiolite to the anolyte liquor whereby to deposit the sepiolite on the diaphragm.

29. In an electrolytic cell having an anode in an anolyte compartment, a foraminous cathode in a catholyte compartment, and an aqueous alkali metal chloride permeable diaphragm therebetween, said diaphragm being deposited on the foraminous cathode, the improvement wherein the diaphragm is prepared by the method comprising:

a. providing a slurry comprising a solvent, a pore forming component, a non-asbestos structural component, and a binder;

b. drawing the slurry through the foraminous structure whereby to deposit the pore forming component, the non-asbestos structural component and the binder thereon;

c. forming a cohesive matrix of the non-asbestos structural component and the binder; and d. removing the pore forming component.

30. The electrolytic cell of claim 29 wherein the pore forming component is removed during formation of the cohesive matrix.

31. The electrolytic cell of claim 24 wherein the pore forming component is chosen from the group consisting of hydrocarbon resins and naturally occurring organic fibers.

32. The electrolytic cell of claim 31 wherein the pore forming component is a cellulosic fiber.

33. The electrolytic cell of claim 29 wherein the binder is a thermoplastic halocarbon resin.

34. The electrolytic cell of claim 33 wherein the thermoplastic halocarbon resin is chosen from the group consisting of fluorinated ethylene propylene, perfluoroalkoxy, copolymers having the moieties $-(CX_1X_2-CX_3X_4)-$ and $-(CY_1Y_2-CY_3Y_4)-$, and homopolymers having the moieties $-(CY_1Y_2-CY_3F)-$ where $X_1$, $X_2$, $X_3$, $X_4$, $Y_1$, $Y_2$, $Y_3$, and $Y_4$ are chosen from the group consisting of —F, —Cl, and H, at least one of said $X_1$, $X_2$, $X_3$, $X_4$, $Y_1$, $Y_2$, $Y_3$, or $Y_4$ being —F.

35. The electrolytic cell of claim 34 wherein the thermoplastic resin is chosen from the group consisting of copolymers having a fluorocarbon resin moiety chosen from the group consisting of $-(CFH-CH_2)-$, $-(CF_2-CH_2)-$, $-(CF_2-CFH)-$, $-(CF_2-CF_2)-$, and $-(CF_2-CClF)-$ and an ethylene moiety.

36. The electrolytic cell of claim 29 wherein the non-asbestos structural component is a mineral fiber chosen from the group consisting of zirconia, titania, barium sulfate, barium titanate, potassium titanate, and alumina.

37. The electrolytic cell of claim 36 wherein the non-asbestos structural component is zirconia.

38. The electrolytic cell of claim 29 wherein the non-asbestos structural component is a resin capable of remaining undeformed at temperatures where the binder is thermoplastic.

39. The electrolytic cell of claim 38 wherein the non-asbestos structural component is polytetrafluoroethylene.

40. The electrolytic cell of claim 29 wherein the solvent has a viscosity greater than about 10 centipoise.

41. The electrolytic cell of claim 29 wherein the solvent has a density of about 1.0 to about 15 grams per cubic centimeter.

42. The electrolytic cell of claim 29 comprising coating the surface of the diaphragm with sepiolite.

43. A cathode-diaphragm unit comprising a perforate cathode having an electrolyte permeable diaphragm thereon comprising non-asbestos fibers and a binder, said diaphragm prepared by the method comprising:

a. providing a slurry comprising a solvent, a pore forming component, a non-asbestos structural component, and a binder;

b. drawing the slurry through the foraminous structure whereby to deposit the pore forming component, the non-asbestos structural component and the binder thereon;

c. forming a cohesive matrix of the non-asbestos structural component and the binder; and d. removing the pore forming component.

44. The cathode-diaphragm unit of claim 43 wherein the pore forming component is removed during formation of the cohesive matrix.

45. The cathode-diaphragm unit of claim 43 wherein the pore forming component is chosen from the group consisting of hydrocarbon resins and naturally occurring organic fibers.

46. The cathode-diaphragm unit of claim 45 wherein the pore forming component is a cellulosic fiber.

47. The cathode-diaphragm unit of claim 43 wherein the binder is a thermoplastic halocarbon resin.

48. The cathode-diaphragm unit of claim 47 wherein the thermoplastic halocarbon resin is chosen from the group consisting of fluorinated ethylene propylene, perfluoroalkoxy, copolymers having the moieties $$\text{-}(CX_1X_2\text{—}CX_3X_4)\text{-}$$

and $$\text{-}(CY_1Y_2\text{—}CY_3Y_4)\text{-},$$

and homopolymers having the moieties $$\text{-}(CY_1Y_2\text{—}CY_3F)\text{-}$$

where $X_1$, $X_2$, $X_3$, $X_4$, $Y_1$, $Y_2$, $Y_3$, and $Y_4$ are chosen from the group consisting of —F, —Cl, and H, at least one of said $X_1$, $X_2$, $X_3$, $X_4$, $Y_1$, $Y_2$, $Y_3$, or $Y_4$ being —F.

49. The cathode-diaphragm unit of claim 48 wherein the thermoplastic resin is chosen from the group consisting of copolymers having a fluorocarbon resin moiety chosen from the group consisting of $\text{-}(CFH\text{—}CH_2)\text{-}$, $\text{-}(CF_2\text{—}CH_2)\text{-}$, $\text{-}(CF_2\text{—}CFH)\text{-}$, $\text{-}(CF_2\text{—}CF_2)\text{-}$ and $\text{-}(CF_2\text{—}CClF)\text{-}$, and an ethylene moiety.

50. The cathode-diaphragm unit of claim 43 wherein the non-asbestos structural component is a mineral fiber chosen from the group consisting of zirconia, titania, barium sulfate, barium titanate, potassium titanate, and alumina.

51. The cathode-diaphragm unit of claim 50 wherein the non-asbestos structural component is zirconia.

52. The cathode-diaphragm unit of claim 43 wherein the non-asbestos structural component is a resin capable of remaining undeformed at temperatures where the binder is thermoplastic.

53. The cathode-diaphragm unit of claim 52 wherein the non-asbestos structural component is polytetrafluoroethylene.

54. The cathode-diaphragm unit of claim 43 wherein the solvent has a viscosity greater than about 10 centipoise.

55. The cathode-diaphragm unit of claim 43 wherein the solvent has a density of about 1.0 to about 1.5 grams per cubic centimeter.

56. The cathode-diaphragm unit of claim 43 comprising coating the surface of the diaphragm with sepiolite.

* * * * *

UNITED STATES PATENT AND TRADEMARK OFFICE

CERTIFICATE OF CORRECTION

PATENT NO. : 4,311,566

DATED : January 19, 1982

INVENTOR(S) : Mary E. McCann

It is certified that error appears in the above-identified patent and that said Letters Patent are hereby corrected as shown below:

Column 10, line 39, "15" should be --1.5--,

Signed and Sealed this

*Twenty-second* Day of *June 1982*

[SEAL]

*Attest:*

GERALD J. MOSSINGHOFF

*Attesting Officer*

*Commissioner of Patents and Trademarks*